United States Patent [19]

Beckey

[11] Patent Number: 4,860,552

[45] Date of Patent: Aug. 29, 1989

[54] HEAT PUMP FAN CONTROL

[75] Inventor: Thomas J. Beckey, Edina, Minn.

[73] Assignee: Honeywell, Inc., Minneapolis, Minn.

[21] Appl. No.: 289,106

[22] Filed: Dec. 23, 1988

[51] Int. Cl.[4] ..... F25B 13/00

[52] U.S. Cl. ..... 62/158; 62/180; 237/2 B

[58] Field of Search ..... 62/160, 180, 209, 158; 236/11, 91 R; 237/2 B

[56] References Cited

U.S. PATENT DOCUMENTS

| | | | |
|---|---|---|---|
| 2,366,003 | 12/1944 | Crago | 236/11 X |
| 2,800,282 | 7/1957 | Calahan | 236/11 X |
| 3,292,387 | 12/1966 | Harbour | 62/158 |
| 3,924,416 | 12/1975 | Durdin | 62/80 |
| 4,094,166 | 6/1978 | Jerles | 62/158 |
| 4,137,725 | 2/1979 | Martin | 62/160 |
| 4,240,404 | 12/1980 | Franchina | 126/427 |
| 4,269,261 | 5/1981 | Kountz et al. | 165/2 |
| 4,324,288 | 4/1982 | Karns | 165/22 |
| 4,366,425 | 12/1982 | Shen | 318/779 |
| 4,453,590 | 6/1984 | Holliday et al. | 62/157 |

FOREIGN PATENT DOCUMENTS

| | | | |
|---|---|---|---|
| 0253754 | 12/1985 | Japan | 62/180 |

*Primary Examiner*—William E. Wayner

*Attorney, Agent, or Firm*—Clyde C. Blinn

[57] ABSTRACT

A control for the indoor air circulating fan of a heat pump when the heat pump is operating in the heating mode. After the compressor starts, the control delays the operation of the indoor fan if the temperature is below a predetermined reference temperature. The delay time increases as the outdoor temperature decreases.

8 Claims, 3 Drawing Sheets

HEAT PUMP FAN CONTROL

BACKGROUND OF THE INVENTION

The present invention is concerned with the operation of a refrigeration heat pump when heating of the conditioned space is being demanded.

The air supplied to the conditioned space from a heat pump is frequently at a temperature of 90° to 100° F., which is lower than most other heating systems. This is due to the heat pump having a lower temperature rise across the indoor heat exchanger as compared to a gas-fired furnace, for example. The heat pump rise may be on the order of 25° F., whereas the gas-fired furnace may be on the order of 65° F. Therefore, there is a potential for complaints about cold drafts, especially during the time period that the indoor heat exchanger coil is being heated to its steady state condition.

Typical operation of a conventional heat pump in the heating mode may be explained as follows. Upon a request for heating by a room thermostat, a refrigerant compressor would be energized. An indoor fan for circulating air over an indoor heat exchanger or coil would be energized at substantially the same time as the compressor is energized. The indoor fan in a conventional system may be energized by a relay that closes a contact to energize the indoor fan when the compressor is energized, for example. Therefore, in the conventional heat pump system, the indoor fan will operate when the compressor operates. This control method results in air being circulated through the indoor coil for some period of time before the coil has been heated to its steady state temperature. During this time period, the occupants of the space may be subjected to discharge temperatures below the steady state condition. This lower discharge air temperature may cause the occupants to experience cool drafts which are generally objectionable during the heating season.

SUMMARY OF THE INVENTION

The present invention is for the control of the indoor air circulating fan of a heat pump to avoid cool air drafts during the heating mode. Operation of the indoor fan is initiated at substantially the same time as the operation of the compressor when the outdoor temperature is above a predetermined temperature. Operation of the indoor fan is delayed for a period of time when the outdoor temperature is below the predetermined temperature, and the period of time delay increases as the outdoor temperature decreases.

IN THE DRAWINGS

DESCRIPTION OF THE PREFERRED EMBODIMENT

Figure 1:
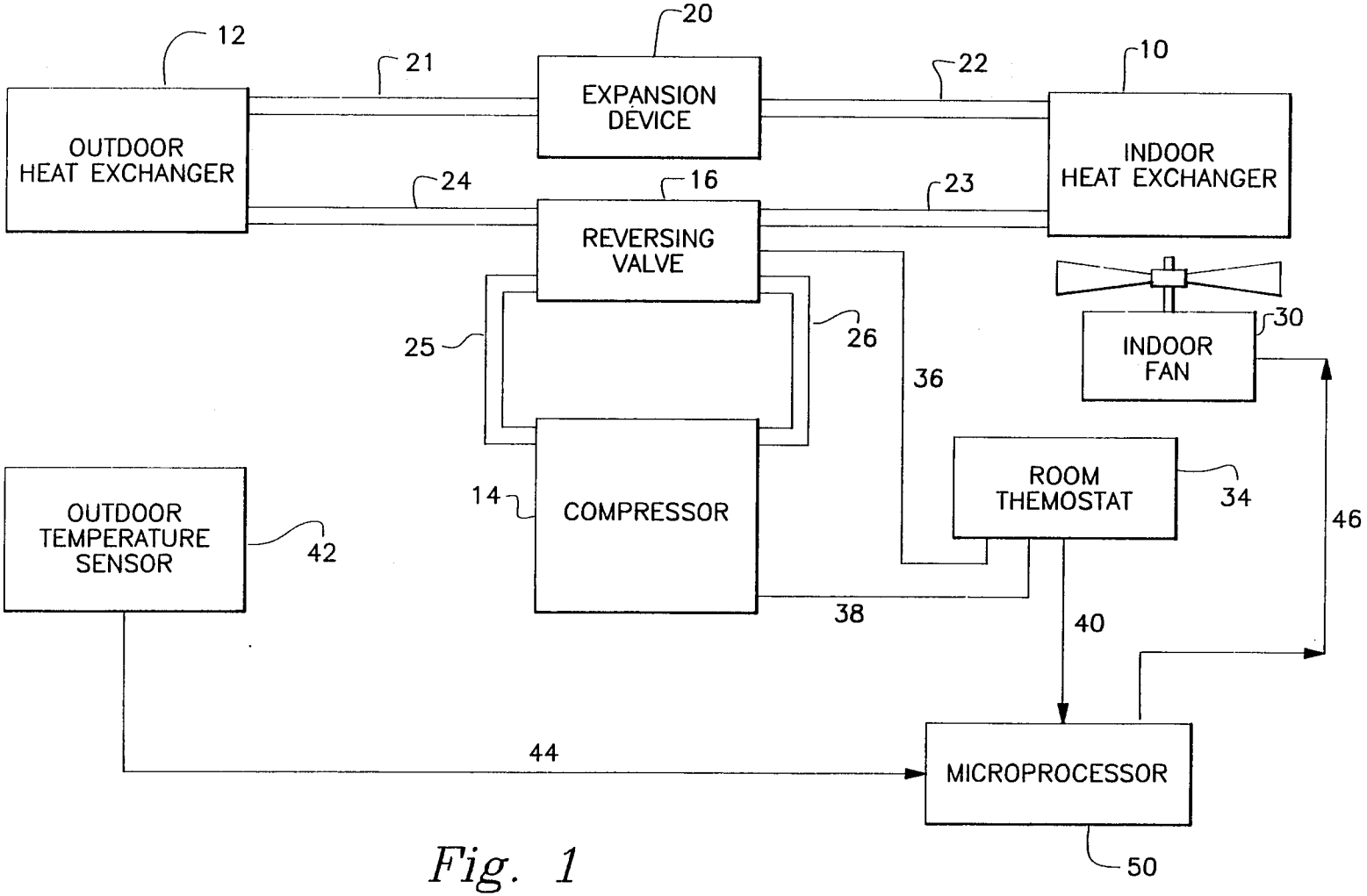
FIG. 1 is a pictorial representation of a heat pump which is controlled in accordance with the present invention.

Referring to FIG. 1, the reverse cycle refrigeration system or temperature conditioning apparatus known as a heat pump comprises an indoor heat exchange coil 10, an outdoor heat exchange coil 12, compressor 14, and refrigerant conduit means interconnecting the coils and compressor, the conduit means including the usual reversing valve 16, an expansion means 20, and appropriate interconnecting piping 21–26. As is well known, such systems function whenever the building thermostat is calling for heating or cooling to cause the compressor 14 to operate. If heating is being demanded, then the compressed hot refrigerant from the compressor 14 will be routed through the reversing valve 16 toward the indoor heat exchange coil 10 where its heat is given up to heat indoor air circulated through coil 10 by fan 30 delivering air to the conditioned space. Conversely, if cooling of the building is being demanded, then the hot refrigerant from the compressor is routed through the reversing valve to the outdoor heat exchange coil where the refrigerant is cooled for subsequent use indoors to cool the conditioned space.

The present invention is concerned only with the heating mode of operation and specifically with delaying the operation of indoor fan 30 under certain outdoor temperature conditions. The purpose of the delay is to allow the indoor heat exchanger coil 10 to become heated before circulating air over the coil thereby eliminating cold drafts in the conditioned space served by the heat pump. The delay time must be limited to a short enough time so that the temperature and pressure of the refrigerant discharged from the compressor 14 remains below certain safety cutout values. The pressure and temperature of the refrigerant discharged from the compressor is dependent upon the refrigerant pressure in the indoor heat exchanger. The refrigerant pressure in the indoor heat exchanger is dependent upon the mass flow of refrigerant discharged from the compressor. As the mass flow of refrigerant discharged from the compressor decreases, the pressure in the indoor heat exchanger will also decrease. The decrease in the indoor heat exchanger refrigerant pressure causes the discharge pressure from the compressor to decrease also. The refrigerant mass flow discharged from the compressor is a function of the compressor speed and the density of the refrigerant entering the compressor. The density of the refrigerant entering the compressor is a function of the pressure and temperature of the refrigerant entering the compressor. As the outdoor temperature falls, the temperature of the refrigerant in the outdoor heat exchanger will also have to fall in order to absorb heat from the outdoor air. The pressure in the outdoor heat exchanger, which is a function of the refrigerant temperature, will also fall. This means that the pressure and temperature of the refrigerant entering the compressor, and therefore the refrigerant density, will decrease as the outdoor temperature decreases. The decrease in refrigerant density as the outdoor temperature decreases will cause the refrigerant flow discharged from the compressor to decrease, which in turn causes the pressure in the indoor heat exchanger to decrease. As a result, the pressure and temperature of the refrigerant discharged from the compressor will decrease.

As a consequence, the delay in the operation of the indoor fan can be increased as the outdoor ambient temperature decreases because it will take longer for the discharge temperature and pressure to reach the safety cutoff values. This increased delay at colder outdoor temperatures is also desirable for eliminating cold drafts in the conditioned space in that the indoor coil will be warmer before air is circulated over the coil. Therefore, the desired control approach is to control the indoor fan to provide either a short delay or no delay during mild outdoor temperatures and to increase the delay during colder outdoor conditions. Specifically, no delay is provided for a predetermined outdoor temperature of about 60° F. and warmer, and a maximum delay of about 1.5 minutes is appropriate for outdoor temperatures of 0° F. and colder.

Turning now to the invention as shown in FIG. 1, it will be assumed that reversing valve 16 has already been positioned for the heating mode. This could be accomplished by a heating-cooling switch built into thermostat 34 for example. The heating-cooling switch would provide a signal on conductor 36 to reversing valve 16.

Figure 3:
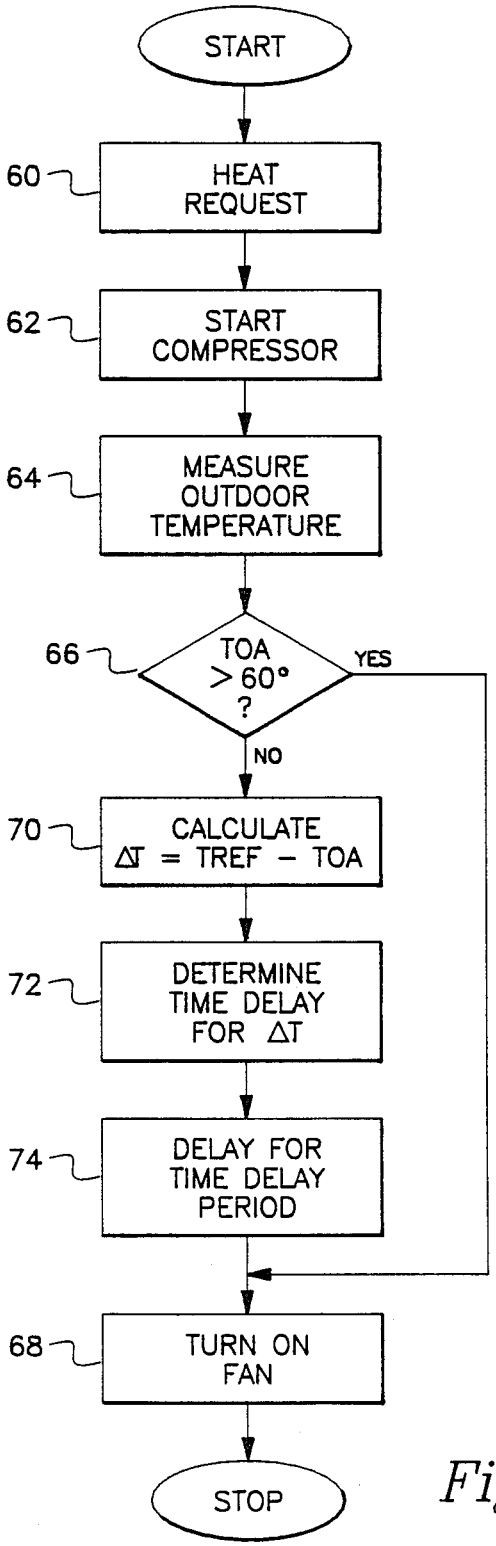
FIG. 3 is a flow diagram of the typical operation of the present invention.

Room thermostat 34 will sense the temperature of the conditioned space. On a request for heating, room thermostat 34 will provide a signal to compressor 14 on conductor 38 by closing a contact, for example. Thermostat 34 will also provide a signal to microprocessor 50 on conductor 40. Microprocessor 50 includes memory (not shown) and operates in accordance with a program stored in the memory. Microprocessor 50 is programmed to accept an analog input signal from an outdoor temperature sensor 42 by means of conductor 44. Microprocessor 50 is programmed to perform the analog-to-digital conversion of the analog signal, or alternatively a separate analog-to-digital converter may be interposed between outdoor temperature sensor 42 and microprocessor 50 with the output of the converter being the input to microprocessor 50. Microprocessor 50 then has available a value of outdoor air temperature and will receive an input signal upon a heat request by thermostat 34. Microprocessor 50 also has an output on conductor 46 which may initiate operation of indoor fan 30. Microprocessor 50 may then be programmed to perform the control sequence shown in the flowchart of FIG. 3.

Figure 2:
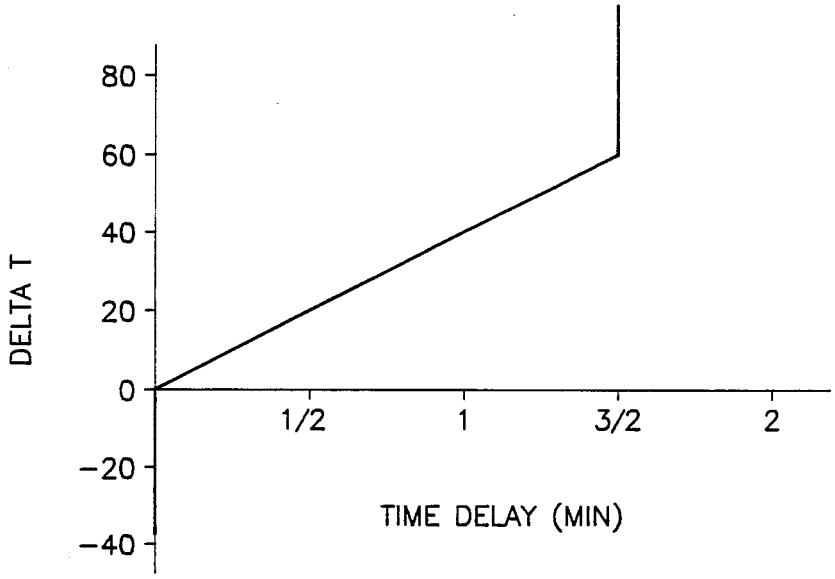
FIG. 2 is a graph of the time delay for indoor fan operation as a function of the difference between a reference temperature and the outdoor air temperature.

A thermostat heat request 60 will cause a signal to start the compressor at 62. The program then advances to measure the outdoor temperature at 64 and then to compare the measured temperature to a predetermined temperature or a reference temperature, for example 60° at 66. When the measured outdoor temperature is greater than 60°, the program advances to 68 and starts the indoor fan. If the outdoor temperature is less than 60°, the program advances to 70 and calculates a value of delta $T=T_{REF}-T_{OA}$, where $T_{REF}$ is a reference temperature and may be taken as 60° F. and $T_{OA}$ is the temperature of the outdoor air in degrees F. The program then advances to 72. A table of delay times for a range of values of delta T is stored in the microprocessor Representative values for the delay time as a function of delta T are shown in FIG. 2. At 72, the program obtains the stored value of delay time corresponding to the delta T calculated at 70. The program then advances to 74 where the delay time obtained at 72 is used to set a time period for delaying the operation of the indoor fan. When the delay time has elapsed, the program advances to 68 and starts the indoor fan.

In accordance with the foregoing description, the invention provides an improved control for a heat pump indoor fan when the heat pump is operating in the heating mode.

While the foregoing specification describes a preferred embodiment of the invention, other embodiments will be apparent to those skilled in the art, without departing from the spirit of the invention which is limited only by the following claims.

What is claimed:

1. A control device for controlling a temperature conditioning apparatus for heating a temperature conditioned space and a fan delivering air heated by a heat exchanger of the apparatus to the space, comprising:

first temperature responsive means for sensing the air temperature of the conditioned space;

second temperature responsive means for sensing the outdoor temperature; and control means responsive to said first and second temperature responsive means for initiating operation of the fan at the same time as the initiation of the operation of the temperature conditioning apparatus when the outdoor temperature is above a predetermined temperature, and for delaying initiation of operation of the fan for a period of time after the initiation of operation of the temperature conditioning apparatus when the outdoor temperature is below said predetermined temperature with said period of time increasing as the outdoor temperature decreases until a maximum period of time for delaying initiation is reached.

2. The device of claim 1 wherein said predetermined temperature is about 60° F.

3. The device of claim 2 wherein said maximum period of time for delaying initiation is about 1.5 minutes.

4. The device of claim 1 wherein said first means for sensing is a room thermostat.

5. In an improvement of a device for controlling a compressor of a refrigeration heat pump for heating a conditioned space, with the heat pump having a fan to deliver heated air to the conditioned space, and a thermostat for sensing the temperature of the conditioned space and for initiating operation of the compressor, the improvement which comprises:

means for sensing the outdoor temperature; and control means responsive to said thermostat and to said sensing means for initiating operation of the fan at substantially the same time as the initiation of the operation of the compressor when the outdoor temperature is above a predetermined temperature, and for delaying initiation of operation of the fan inside the space for a period of time when the outdoor temperature is below said predetermined temperature, with said period of time increasing a the outdoor temperature decreases until a maximum period of time for delaying initiation is reached.

6. The device of claim 5 wherein said predetermined temperature is about 60° F.

7. The device of claim 6 wherein said maximum period of time for delaying initiation is about 1.5 minutes.

8. In an improvement of a device for controlling a compressor of a refrigeration heat pump for heating a conditioned space, with the heat pump having a fan to deliver heated air to the conditioned space, and a thermostat for sensing the temperature of the conditioned space and for initiating operation of the compressor, the improvement which comprises:

means for sensing the outdoor temperature; and control means responsive to said thermostat and to said sensing means for initiating operation of the fan at substantially the same time as the initiation of the operation of the compressor when the outdoor temperature is above a predetermined temperature, and for delaying initiation of operation of the fan for a period of time when the outdoor temperature is below said predetermined temperature, with said period of time increasing as the outdoor temperature decreases to reduce the amount of undesired unheated air which is delivered to the conditioned space upon initiation of the operation of the heat pump.

* * * * *